United States Patent [19]

Lach et al.

[11] Patent Number: 4,770,164

[45] Date of Patent: Sep. 13, 1988

[54] RESUSCITATION METHOD AND APPARATUS

[76] Inventors: Ralph D. Lach, 2427 Tremont Rd., Columbus, Ohio 43221; Elmer C. Lusk, 1173 Oakland Ave., Columbus, Ohio 43212

[21] Appl. No.: 197,670

[22] Filed: Oct. 16, 1980

[51] Int. Cl.[4] ..... A61H 31/00

[52] U.S. Cl. ..... 128/28

[58] Field of Search ..... 128/28

[56] References Cited

U.S. PATENT DOCUMENTS

| | | | |
|---|---|---|---|
| 651,962 | 12/1899 | Boghean | 128/28 |
| 1,351,066 | 8/1920 | Robinson | 273/29 BA |
| 1,399,034 | 12/1921 | Taplin | 128/28 |
| 2,071,215 | 2/1937 | Petersen . | |
| 2,480,980 | 9/1949 | Terhaar . | |
| 2,484,306 | 10/1949 | McClain et al. | 128/28 |
| 2,486,667 | 11/1949 | Meister . | |
| 3,078,842 | 2/1963 | Gray | 128/30.2 |
| 3,425,409 | 2/1969 | Isaacson | 128/54 |
| 3,777,744 | 12/1973 | Fryfogle | 128/28 |
| 4,004,579 | 1/1977 | Dedo | 128/28 |
| 4,060,079 | 11/1977 | Reinhold . | |

*Primary Examiner*—Richard C. Pinkham
*Assistant Examiner*—T. Brown
*Attorney, Agent, or Firm*—C. Henry Peterson

[57] ABSTRACT

A patient (10) having cardiocirculatory arrest is resuscitated using a supple band (12) that is passed around the thorax (14). The thorax is clasped at its side portions, for example, between contoured band-guide assemblies (16 and 18), one (16) being fixed and the other (18) adapted for traversing movement. The band is guided, as by the assemblies (16 and 18), over the clasped portions of the thorax so that a tautening of the band exerts the clasping action and produces force components (62, 64, 66, 68) directed inwardly of the thorax around a major portion of its periphery. The band is alternately tautened and loosened, for example, using a pull roller (72) driven manually through a torque-measuring wrench handle (110) or by a motor device (170). The tautness of the band may be limited as by an adjustable mechanical stop arrangement (128, 130, 132).

48 Claims, 3 Drawing Sheets

FIG. 4
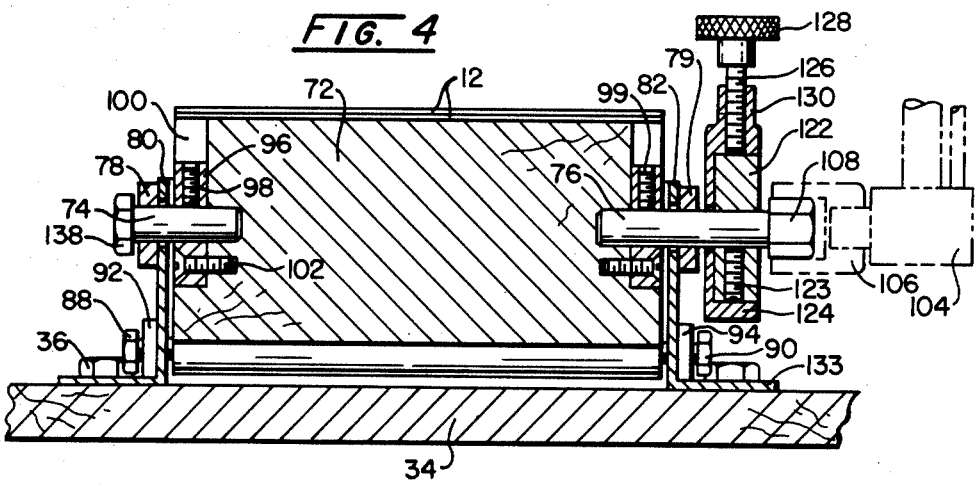
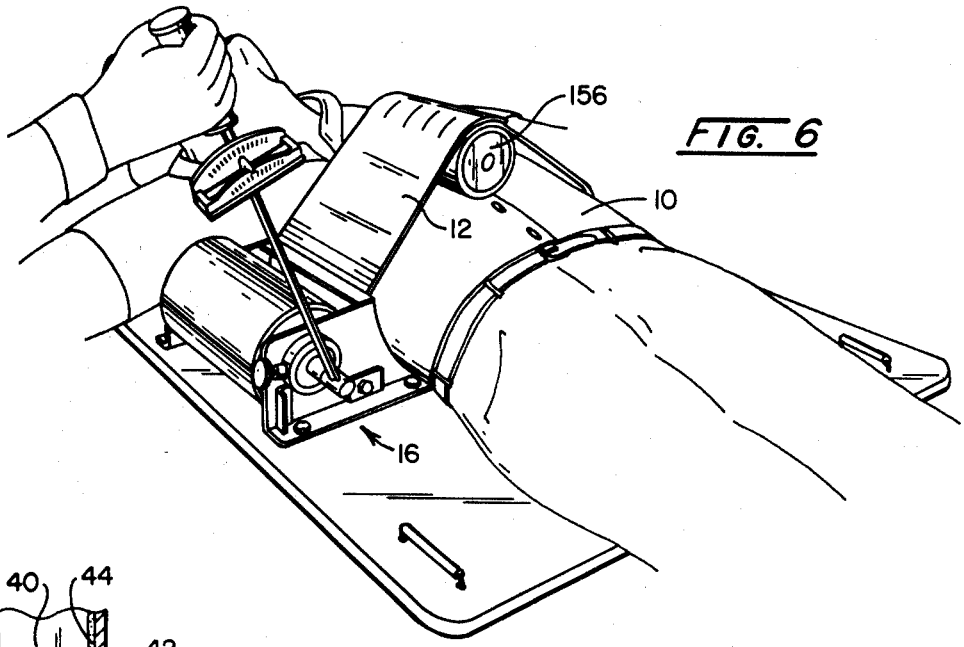
FIG. 6
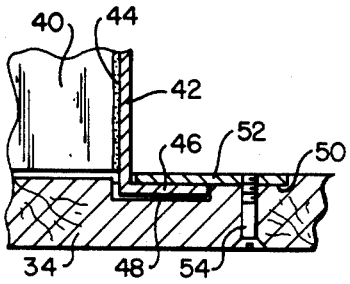
FIG. 5
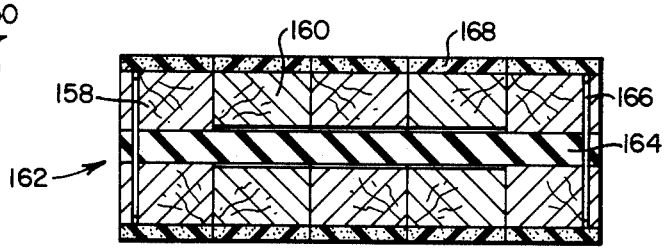
FIG. 7

RESUSCITATION METHOD AND APPARATUS

TECHNICAL FIELD

This invention relates to methods and apparatus for resuscitating a patient having cardiocirculatory arrest, and more particularly it relates to such methods and apparatus using a supple band to produce generalized compressions of the thorax.

BACKGROUND

U.S. Pat. No. 2,480,980 to Terhaar recognizes that blood circulation can be influenced by general pressure changes around the chest. U.S. Pat. No. 3,078,842 to Gray has proposed a method and apparatus for applying alternating pressures to the thorax at the respiratory rate, and superimposing thereon sharp pressure bursts or pulses at the cardiac pulse rate, to promote or effectuate blood circulation.

A considerable body of pertinent information has been summarized in two recent articles, viz., Fenster, P. E. and Ewy, G. A., "Cardiopulmonary Resuscitation: Recent Insights and New Developments," *Practical Cardiology,* Vol. 6, No. 5, May 1, 1980 pp. 15–19, and Chandra, N., Rudikoff M. and Weisfeldt, M. L., "Simultaneous Chest Compression and Ventilation at High Airway Pressure During Cardiopulmonary Resuscitation," *The Lancet,* Jan. 26, 1980, pp. 175–178. While these two articles do not necessarily antedate the present invention, the articles and their respective bibliographies are incorporated by reference herein to provide background and theoretical information.

Conventional cardiopulmonary resuscitation (CPR) dates back to the efforts of Jude and Kouwenhoven who in 1959, described maintaining effective circulation with precordial compression. It was popularly thought at that time and the idea was promulgated and accepted, that the motive force was the result of compression of the left ventricle between the sternum and the vertebral column.

Considerable evidence is now available to suggest that the real mechanism of circulation is the effect of the abrupt increase in intrathoracic pressure on the aorta and great vessels. This compression of the elastic aorta, in the presence of a competent aortic valve propels the blood into capillary circulation in a "forward" fashion.

The first piece of evidence relates to the well-known effect of repetitive coughing which is utilized in most cardiac catheterization laboratories in response to prolonged bradycardia, or cardiac arrest. Patients are commonly instructed prior to catheterization to cough sharply and repeatedly upon command. The effect of this coughing is readily apparent since these patients commonly are under circumstances of physiologic recording of intra-arterial pressure. Commonly such coughing produces systolic blood pressures over 100 mm. of mercury, and this critical perfusion technique can be continued even in the face of ventricular fibrillation or asystole. The mechanism here includes utilization of the voluntary muscles of coughing, including intercostals, abdominal muscles and diaphragms (the effect on the abdominal aorta may also have to be considered in light of the abdominal compression methods that have been used to add to the efficience of cardiac massage. These have been reported in the last year.)

The second item of evidence relates to recent Doppler flow studies which reveal that, with standard CPR techniques, aortic flow begins before the opening of the aortic valve. This also indicates a noncardiogenic flow phenomenon.

Since the turn of the century, there have been many proposals for machines to assist or to automatically effectuate respiration by external compression of the thoracic and/or abdominal regions. U.S. Pat. No. 651,962 to Boghean has proposed a respirator comprising a plurality of rigid plates shaped to engage the thorax and mounting rollers on the outside for guiding a cord that is automatically tautened and loosened periodically by the action of a pull roller operated by a cam and motor arrangement. Other examples of respirators using bands or straps are described in the U.S. Pat. Nos. 2,071,215 Petersen, 2,486,667 Meister, 3,777,744 Fryfogle and 4,004,579 Dedo. Straps or bands may be combined with manually operated or power driven pad and plunger arrangements that exert localized pressure on the sternum in a manner that simulates manual CPR methods of maintaining blood circulation, for example, as described in the U.S. Pat. Nos. 3,425,409 Isaacson and 4,060,079 Reinhold.

To be effective, both manual CPR methods and mechanically implemented or assisted methods that depend mainly on the application of pressure to the sternum often require the use of force sufficient to produce incipient damage to the body structures of the patient. Many otherwise qualified persons have been physically incapable of performing effective manual CPR because they lack sufficient strenth, body weight, or agility. On the other hand, the use of excessive or misdirected force can result in severe injury to the patient. If a sufficient and adequately abrupt increase in the intrathoracic pressures can be generated by the application of forces properly distributed over wider areas of the thoracic periphery, the probability and extent of injuries should be substantially reduced.

There have been many proposals for resuscitation jackets or cuirass units whereby pneumatic pressure variations could be used to apply evenly distributed forces to the thoracic regions. These units or jackets were designed basically to produce artificial respiration or to assist natural breathing. The Terhaar and Gray patents supra contain what are essentially proposals to adapt the then-existing respirator designs so that they could be used to resuscitate patients suffering from cardiocirculatory arrest. These designs, like those proposing compression devices using cords, bands or straps for distributing pressures around the thorax as in the Boghean, Petersen, Meister, Fryfogle and Dedo patents supra do not seem well adapted for cardiocirculatory resuscitation.

The situation of a patient undergoing cardiocirculatory arrest is much more critical in many respects, than that of one merely requiring respiratory aid. The time problem is especially acute, since the patient can suffer brain damage around four minutes after the heart stops, and if circulation is not restored before six minutes have elapsed, brain damage is almost certain to occur. Frequently some or most of this critical time will already have elapsed before the situation of the patient is discovered and the cardiac arrest is confirmed. Cardiocirculatory resuscitation requires considerably greater thoracic compression forces than those necessary for respiratory resuscitation. The cardiocirculatory resuscitation forces need to be applied and released more abruptly, at a much higher alternation frequency, and with the exercise of a greater measure of control. Frequently the resuscitative application of the rhythmic thoracic compressions needs to be carried out without interruption simultaneously with the use of fluoroscopy as an aid to examination and/or to the placement of catheters in or near the heart.

Accordingly there is at present a need for improved methods and apparatus for resuscitating a patient having cardiocirculatory arrest; which methods and apparatus can be routinely placed in operation in less than about ten seconds after the patient is in position; which adjust in a semiautomatic or automatic manner to patients of disparate body shapes and sizes; which readily permit the application of adjustable, reproducibly measured and continually monitored pressures and thoracic compression distances as specified by the physician or other person in charge; which can apply such pressures that are either uniform around the major portion of the thorax or locally intensified at a selected portion thereof such as over the sternum; which minimize the probability of inflicting bodily structural damage or skin irritation on the patient; which can be converted in a few seconds from a manual mode of operation to a power driven, automatic cycling mode and vice versa; which in the manual mode provide a mechanical advantage to ease the effort of the operator and are operable with a natural body movement from an adjustable and relatively comfortable body position; which keep the front and rear areas of the thorax clear and free of any activity or appurtenances that can interfere with the use of a fluoroscope for placing heart catheters while CPR is in progress, and which can include a base or support that will serve as a litter for handling and transporting a patient, even allowing effective CPR activity to be continued while the patient is in transit.

SUMMARY

In accordance with this invention, methods and apparatus are provided whereby a patient having cardiocirculatory arrest can be resuscitated by passing a supple band around the thorax of the patient, clasping the thorax at its side portions and guiding the band for longitudinal movement over the clasped portions so that a tautening of the band exerts the clasping action and produces force components directed inwardly of the thorax around a major portion of its periphery, tautening the band so as to produce intrathoracic pressures sufficient to propel the blood of the patient into effective capillary circulation in the extrathoracic regions, loosening the band so as to allow the elastic tissues of the patient's body to return blood to the intrathoracic region, and continuing to alternately tauten and loosen the band in a resuscitative rhythm.

Typically the clasped portions of the thorax are the posterior side portions. The tautening step may comprise drawing a portion of the band to one side of the thorax while opposing bodily movement of the thorax to said one side.

Typically a limit is set for a parameter affecting the tautness of the band, and the limit is enforced each time the band is tautened.

The oand may be divisible into two portions that are separable and rejoinable, and the method may comprise rejoining the two portions when the band is passed around the thorax of the patient.

The patient may be juxtaposed with a base member and with first and second band-guide members contoured to clasp the thorax at its side portions. The clasping action may comprise traversing one band guide member with respect to the base member. The other band-guide member may be used to oppose bodily movement of the thorax to the one side. Said other band-guide member may be secured to the base member at said one side.

The band may be drawn to the one side of the thorax by wrapping a portion of the band on a pull roller and exerting a torque on the pull roller in order to tauten the band. Typically a limit is set for the torque on the pull roller as the parameter affecting the tautness of the band. The longitudinal distance traveled by a portion of the band may be used as a parameter affecting the tautness of the band. Typically the limit is enforced by a mechanical stop for the movement of the pull roller to tauten the band.

X rays may be directed to pass between the band-guide members, from one of the front and rear portions of the thorax to the other and through the band, and the rays emerging from the thorax may be detected to produce a visual image of structures inside the thorax. The base member may have a portion constructed of a material having a low density, a substantially uniform thickness and a low effective atomic number, and the directed X rays may be passed through said portion.

The base member may comprise a support for the patient, and the patient may be placed on the support in order to be resuscitated. The base member may be lifted in order to transport the patient from one place to another. The resuscitative rhythm of alternately tautening and loosening the band may be continued while the patient is being so transported.

The inwardly directed force components on a portion of the thorax may be intensified by placing a semirigid, surface-cushioned pad between the thorax portion and the band.

The torque may be exerted on the pull roller by hand-operated lever means having a multiplicity of operating positions. The lever means may include torque measuring or torque-limiting means.

A rotary brake means may determine the position of the pull roller when the mechanical stop is engaged. The limit for the parameter affecting the tautness of the band may be set with the brake released by tautening the band with the mechanical stop engaged and applying the brake.

DRAWINGS

Figure 2:
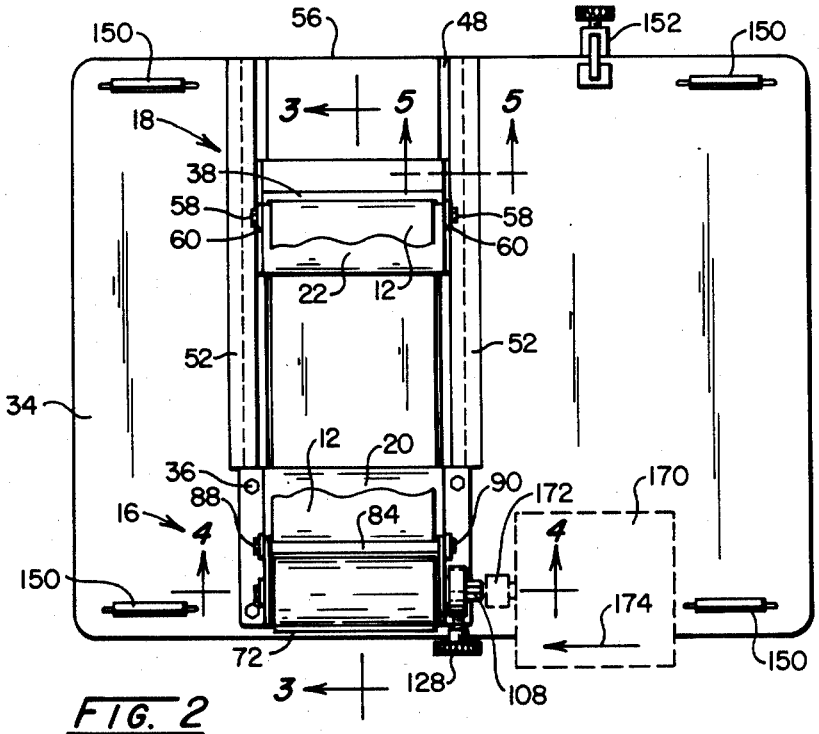
FIG. 2 is a plan view of the apparatus of FIG. 1 with the patient removed therefrom, and with portions of the band 12 removed to more clearly show portions of the other apparatus under the band.

FIG. 4 is a section on the line 4—4 of FIG. 2, with the brake cup 124 and knurled knob assembly 128 rotated 90° to show their construction.

FIG. 5 is a partial section on the line 5—5 of FIG. 2.

Figure 1:
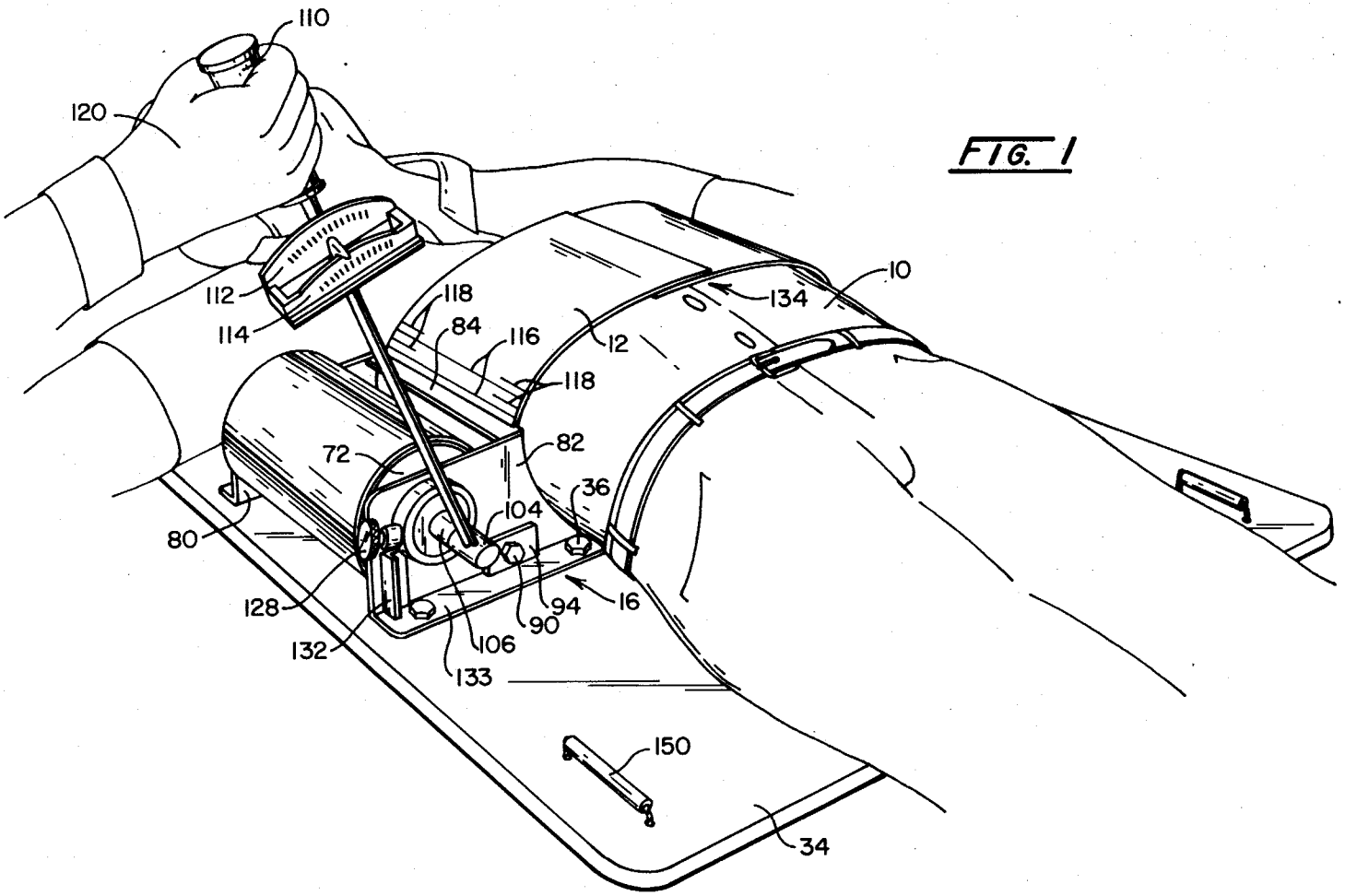
FIG. 1 is a perspective view showing a patient being resuscitated using methods and apparatus according to the invention.

FIG. 6 is similar to FIG. 1, showing the use of a pressure intensifier 156.

FIG. 7 is a section through the axis of the pressure intensifier 156 of FIG. 6.

BEST MODE FOR CARRYING OUT THE INVENTION

FIG. 1 shows a representation of a patient 10 who is assumed to have a cardiocirculatory arrest.

Figure 3:
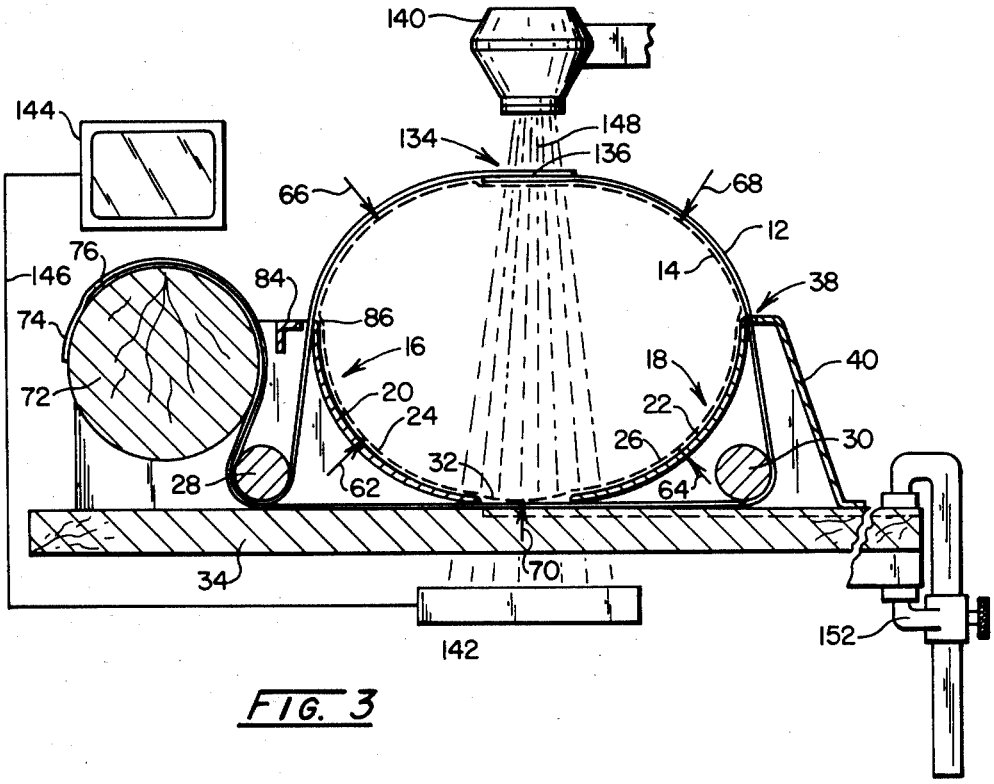
FIG. 3 is a section on the line 3—3 of FIG. 2, including fluoroscopic apparatus not shown in FIG. 2. 2.

As best shown in FIGS. 1 and 3 a supple band 12 has been passed around the thorax of the patient. In FIG. 3 the periphery of the thorax is represented by a dashed line 14. The side portions of the thorax are clasped by first and second band-guide means 16 and 18. As shown, the band-guide means 16 and 18 include respective contoured portions 20 and 22 adapted to clasp the thorax 14 at its posterior side portions 24 and 26.

The band-guide means 16 and 18 are adapted, as shown, by means including respective rollers 28 and 30, for guiding the band 12 over the clasped portions 24 and 26 of the thorax 14. The region of the band 12 that is guided over the thorax side portion 24 passes under the roller 28. The region of the band 12 that is guided over the thorax portion 26 passes under the roller 30. From the roller 30 the band courses to the left as shown in FIG. 3, under the rear portion 32 of the thorax 14, and thence under the roller 28 as a contiguous second layer of the band.

In the embodiment shown, the one band-guide means 16 is secured to a base member 34 by bolts as at 36. The other band-guide means 18 is mounted for traversing movement with respect to the base member 34 and the one band-guide means 16 to permit the band-guide means to exert a clasping action on the thorax portions 24 and 26.

As best shown in FIG. 3, the band 12 coursing upwardly from roller 30 passes through a nip 38 formed between the contoured piece 22 and an outer guard panel 40. The contoured piece 22 and guard panel 40 extend between a pair of end plates, one of which is shown at 42 in FIG. 5. In a prototype that has been constructed, the end plates as at 42, the contoured piece 22 and the guard panel 40 were made of stainless steel, fastened together by welds as at 44 in FIG. 5, and smoothed on the outside. The base member 34 was constructed of plywood. However, it is anticipated that all of these parts can be made from molded plastic in a production model.

Each of the end plates as at 42 has an outwardly turned flange as at 46 adapted to travel along an extended, linear groove as at 48 in the base member 34. The grooves as at 48 are stepped to include a shallower portion 50 for mounting an inlaid retainer strip 52 that is secured to the base member with a plurality of countersunk screws as at 54 that are threaded into the strip 52. The strip 52 extends over the flange 46 to retain the end plate 42 in position while allowing the band-guide assembly 18 to traverse along the length of the grooves 48. The grooves 48 extend all the way to the one edge 56 of the base member 34, so that the band-guide assembly 18 can be easily separated from the base member to facilitate threading of the band 12. The roller 30 is mounted on steel bearing studs 58 (FIG. 2) that extend through holes (not shown) in the end plates 42. In the prototype constructon shown, these holes are enlarged, and the bearing studs 58 rotate in brass bearing plates 60 secured to the outside of the end plates 42 with countersunk screws (not shown). A similar construction is more clearly shown in FIG. 4 and described hereinafter.

As can be seen most clearly from FIG. 3, when the band 12 is tautened, since the band-guide assembly 18 including the roller 30 is free to traverse to the left, the tautening of the band 12 exerts the clasping action that presses the contoured portions 20 and 22 of the band-guide means 16 and 18 against the side portions 24 and 26 of the thorax 14. The tautening of the band thereby exerts force components, as represented by arrows 62 and 64 as well as force components as represented by arrows 66 and 68, directed inwardly of the thorax 14 around the major portion of its periphery. As an effect of gravity and as a reaction to the downward components of forces as at 66 and 68, the member 34 and the band 12 exert some upward forces as represented by an arrow 70 on the rear portion 32 of the thorax.

Due to the interposition of the band-guides 16 and 18 there is no substantial rubbing or shearing action on the skin or flesh of the patient covering the posterior side portions 24 and 26 of the thorax 14. There is some frictional engagement of the band 12 with the rear thorax portion 32. This depends on the magnitude of the inwardly-directed force components as at 70 which in turn depend on the location of rollers 28 and 30. In the embodiment shown, these rollers are set to minimize force components 70 by being symmetrically located as close as possible to the base 34 while allowing sufficient clearance to thread the plural-thickness band 12 under roller 28. Friction against the rear portion 32 of the thorax can be further reduced by placing a thin sheet of polytetrafluoroethylene resin plastic between the patient and the base 34 and the contoured portions 20 and 22, but this is at present believed to be unnecessary.

As best shown in FIGS. 1 and 3, a means exemplified by a pull roller 72 cooperates with the one band-guide means 16 to draw a portion of the band 12 to one side (the right side) of the thorax 14 while opposing bodily movement of the thorax to that side. The ends 74 and 76 of the band 12 are detachably secured to the pull roller 72 by hook and loop fastener panels of the type of fabric marketed under the trademark Velcro. The hook panels are cemented to the ends 74 and 76 of the band 12, and the loop panels are cemented to the pull roller 72. In the prototype, the pull roller was made of wood, although in a production model a suitable plastic may be preferred. With the loop panels cemented to the pull roller 72, the band 12 can be removed and rethreaded, if desired, around the roller 72 in the opposite direction, so that the band may be tautened by turning the pull roller 72 clockwise instead of counterclockwise as in the arrangement shown. While the band 12 is shown for clarity as being only partially wrapped around the pull roller 72, ordinarily there will be several wraps on the roller depending on the length of the band selected and the size of the patient.

As best shown in FIG. 4, the pull roller 72 is mounted on bearing studs 74 and 76 that extend through brass bearing plates 78 and 79 and stainless steel end plates 80 and 82 similar to those described in connection with the band-guide assembly 18 (FIGS. 2 and 5). The end plates 80 and 82 are welded to the contoured piece 20 and to a guard 84 that, like guard panel 40, prevents forcible bodily contact with the relatively sharp edge 86 of its respective contour piece 20. The band-guide roller 28 (FIG. 3) is also mounted between end plates 80 and 82 and on bearing studs 88 and 90 (FIG. 4) that rotate in brass bearing plates 92 and 94 secured to the end plates 80 and 82 with countersunk screws (not shown).

To adapt the pull roller 72 for mounting on bearing studs 74 and 76, the roller 72 is axially counterbored at both ends to receive respective collars as at 96. The collars are secured to the bearing studs with set screws 98 and 99 that can be installed and tightened with an Allen wrench through radial passages as at 100 in the roller 72. The collars 96 are secured to the pull roller 72 with countersunk screws as at 102. Since the set screws as at 99 must transmit substantial and continual torque pulsations, they may have matching flats or drilled indentations in the studs as at 76.

In the prototype shown, for manual operation the pull roller 72 is rotated to tauten and loosen the band 12 using a typical ordinary mechanic's torque wrench 104 with a 12-point socket 106 that fits over the hexagonal head 108 (FIG. 4) of bearing stud 76. This provides a multiplicity of operating positions for the handle 110 (FIG. 1). The head 108 of stud 76 is elongated to reduce the chances that the socket 106 could slip off accidentally. The wrench 104 shown is of the torque-indicating type having both pounds-inches 112 and newton-meters 114 scales.

The indicated torque is a conveniently usable parameter affecting the tautness of the band 12 and thereby the pressure exerted on the patient's thorax 14. Another such parameter is the longitudinal distance traveled by a portion of the band 12 as it is alternately tautened and loosened. As shown in FIG. 1, the latter parameter is indicated by indicia comprising one-inch (2.54 centimeter) markers 116 extending the full width of the band 12, and ½-inch markings 118 on the edges of the band 12. The position of these markers can be noted relative to the edge of the guard 84.

The amount of pressure to be applied to the thorax during a resuscitation may be specified, by the attending physician or other person in charge, in terms of one of these parameters. Provision is made for setting a limit for the selected parameter, and for automatically or semiautomatically enforcing the limit each time the band 12 is tautened. In this way the applied pressure can be held uniform despite the occurrence of operator fatigue, change of hands as at 120 on the operating handle 110, change of operators and the like.

To this end, as best shown in FIG. 4 a brake disk 122 is secured to the bearing stud 76 with a set screw 123. A brake cup 124 is sized and installed to rotate freely on the stud 76 and around the disk 122. The threaded shaft 126 of a knurled knob 128 is screwed through a radial portion of the cup 124 that carries a reinforcing boss 130. When the knurled knob 128 is turned clockwise, the end of the threaded shaft 126 presses against the periphery of the disk 122. This shifts the axis of the cup 124 with respect to the axis of the disk 122, frictionally locking the cup 124 and boss 130 in a fixed angular position with respect to the bearing stud 76 and pull roller 72.

The boss 130 and an upstanding striker post 132 constitute a mechanical stop. The post 132 is a right angular metal strip secured to the end plate 82 with screws (not shown). The bottom end of post 132 rests on the outwardly turned flange 133. To set the limit, according to one procedure the band 12 may be tautened enough to produce a slight compression of the thorax and then loosened to allow the elastic structures of the thorax to expand to normal condition. The position of the band can then be noted using indicia 116 and 118. With the knurled knob 128 brake control loosened, the wrench handle 110 is pulled until the prescribed value of the torque or band travel parameter is registered using scales 112 or 114 or indicia 116 and 118. With the boss 130 against the striker post 132, the knurled knob 128 is turned clockwise to lock the brake. The mechanical stop so adjusted will now enforce the tautness limit each time the band is tautened.

To allow a patient to be very quickly placed in position for resuscitation on the apparatus, the band 12 is made divisible into two separable and rejoinable portions. These portions are separable and rejoinable at an overlapping region 134 that is typically placed in the center of the patient's chest as shown in FIGS. 1 and 3. At their junction 136, the overlapping portions are typically faced with mating panels of hook and loop (Velcro) fastener fabric. In the prototype, which utilizes an 8½-inch wide band 12 it was found that a two-inch fastener panel was quite adequate to withstand the pull necessary for cardiac resuscitation of an adult of any size. The fastener panels can be either sewed or cemented to the fabric of band 12.

When the apparatus is ready to receive a patient, it appears somewhat as shown in FIG. 2. In FIG. 2, the two portions of the band 12 are shown folded inwardly and cut off so as to reveal the contoured portions 20 and 22 as well as the guards 38 and 84. In the state of readiness to receive a patient, the ends of the band 12 are folded outwardly so the patient can be placed between the contoured portions 20 and 22. With the patient in position, the ends of the band 12 are overlapped over the chest and pressed together to engage the hooks and loops, thereby rejoining the band portions. The wrench handle 104 and socket 106 will have been removed when the apparatus was placed in a condition of readiness, so the pull roller 72 can now be turned rapidly by hand to take up the slack in the band 12 and to cause the band guide assembly 18 to traverse inwardly until the patient's thorax 14 is clasped between the contoured portions 20 and 22. The wrench handle 104 is picked up and held in its most comfortable operating position while the socket 106 is placed over the head 108 of stud 76 that is used to drive the pull roller 72 with the required resuscitative torque. These operations, together with the setting of the tautness limit stop as above described will take an experienced and well-practiced operator only a few seconds to accomplish. The resuscitative rhythm can then begin at once.

If desired, the pull roller 72 can be driven through the other bearing stud 74 by placing the wrench socket 106 over the stud head 138 instead of stud head 108. This procedure might be selected, for example, by a lone operator who expects to find it necessary to administer mouth-to-mouth respiration as well as to operate the apparatus. Such an operator may arrange to station himself on the opposite (left) side of the patient body. In this case he may wish to reach across the patient's body and pull on the handle 110. If so, as previously noted the band 12 is rethreaded beforehand to wrap in the opposite direction around pull roller 72.

FIG. 3 shows, associated with the resuscitator apparatus, a representation of conventional fluoroscopic apparatus that may be used for examination, placement of heart catheters and the like, without interrupting or interfering with resuscitative operations in process. The fluoroscopic apparatus illustrated comprises an X-ray generator and collimator head 140, X-ray detecting means represented by box 142 that may comprise for example, an X-ray camera or self-scanning photodiode array, and a cathode ray tube display unit 144 that is connected to unit 142 via a cable 146.

The head 140 directs X rays 148 to pass between the band-guide members 16 and 18, from the front to the rear portion of the thorax 14 and through the band 12 and base member 34. The detecting means 142 detects the X rays emerging from the rear portion 32 of the thorax 14 and penetrating base member 34. A visual image of the structures inside the thorax 14 is thus provided on cathode ray tube display unit 144. The base member 34 is of substantially uniform thickness and is constructed of a material such as wood (as shown) or plastic that has a low effective atomic number and low density. It is thus unnecessary to produce excessively high-energy X rays by using excessively high X-ray tube voltages, and there is little loss of contrast between the intrathoracic structures being viewed. The hook and loop fasteners at the junction 136 of the overlapped portions of the band 12 are of the type having plastic hooks in the array thereof, for similar reasons.

There is no objection to the illustrated use of stainless steel for the contoured portions 20 and 22 of the band-guide means 16 and 18, since there is a minimum gap of about ten centimeters (four inches) between these members when they clasp the thorax of a small patient. Obviously the necessary greater gap is automatically provided when a larger patient occupies the apparatus.

Instead of the electronically enhanced viewing system shown, if necessary the fluoroscopic apparatus can be of the type using an old style phosphor or scintillator screen placed over the chest of the patient. In this case the X-ray head 140 would be placed under the base 34 to direct the X rays through the thorax 14 from the rear 32 to the front portion thereof.

In principle, the base member 34 need be only long and wide enough to support the band-guide and pull roller assemblies, since it can be placed across a bed, table, stretcher or on the ground to provide support for the patient. However, in the prototype shown, the dimensions selected were 30 inches (76 centimeters) wide by 36 inches (91 centimeters) long. This is adequate to provide a support for transporting an adult patient. The 30-inch width was selected as the largest that would pass freely through a standard 32-inch (81 centimeters) door, although this may be inadequate to accommodate an exceptionally large patient. The 36-inch dimension was selected for ease of handling. The length at the patient's head end was made short enough to allow the adult patient's head to extend over the edge. This tends to automatically keep the patient's airway passage open while in transit on the support, although obviously other support for the head must be provided if there is a chance that the neck is broken.

Lifting handles as at 150 have been provided on base 34. They, are made of cotton rope passing through polyethylene tubing hand grips to minimize the chances of injury to the patient.

For more stable operation, to prevent the base 34 from tipping or shifting on a bed or table, a suitable anchoring device such as a commercial clamp 152 may be provided. This may be especially helpful when resuscitating a small patient, and particularly when using the comfortable and convenient position of the handle 110 shown in FIG. 1 that keeps the chest area free of activity and appurtenances. The clamp 152 can, if appropriate, be connected through a strap and buckle arrangement (not shown) to an auxiliary plastic hook that can be hooked over a more distant object such as a bed spring or rail.

In a manner exemplified by the showing of FIG. 6, it may be necessary or desired to intensify the inwardly directed force components on one portion of the thorax, such as the sternum. To this end, there has been provided a semirigid, surface-cushioned pad 156 that can be placed between the sternum and the band 12. The pad 156 increases the pressure on the sternum while relieving the pressure of the band 12 on the ribs adjacent to the sternum.

As shown in FIG. 7, the pad 156 comprises five right circular cylindrical wooden disks as at 158 and 160 with an axial bore 162 to loosely accommodate a rubber shaft 164. Shaft 164 is secured to the two end disks with steel rods as at 166 driven through undersize diametrical passages in the disks. The peripheral surfaces of the disks are covered with a prosthesis liner material 168 such as that marketed under the trademark Pelite. The rubber shaft 164 permits the disks as at 158 and 160 to become axially misaligned under pressure so as to conform to the contour of the sternum.

It is apparent that pads of a variety of different sizes and shapes can be made for patients of disparate sizes and shapes and to produce different degrees of force intensification at different portions of the thorax. The use of a pad or pads may be deemed appropriate, for example, for a woman patient with large breasts. It is further apparent that the particular intensifier pad 156 illustrated is designed to produce an effect approaching that of manual CPR using the heel of the hand on the sternum. However, since the band 12 and guides as at 16 still exert uniform pressure on the back and sides of the thorax, the necessary distance the sternum must be depressed should be significantly reduced and the chances and degree of injury should be lessened.

The foregoing is a description of the resuscitator apparatus of the invention as adapted for manual operation. The dashed line box 170 in FIG. 2 represents what is herein designated as "motor means", whereby the apparatus may be adapted for operation from a power source such as an electrical or compressed gas source. While the specific structure of a suitable motor means forms no part of the presently claimed invention and hence requires no detailed description or illustration herein, it is appropriate to outline some general requirements and suggestions.

For convenience and to expedite conversion from manual to power operation, the motor means 170 can be carried on a mounting plate (not shown) adapted to be positioned in or on locator holes or pegs in the base member 34 and secured thereto with a quick clamp mechanism. The mounting plate and motor means 170 can include a slide similar to that above described for traversing the band-guide means 18, whereby the motor means 170 can slide to the left as shown by an arrow 174 and allow an attached wrench socket 172 to slip over the head 108 of the bearing stud 76 that drives pull roller 72. The manual wrench arrangement previously described can be used on the other bearing stud head 138 to pull the band 12 to the desired degree of tautness, and a clutch connecting the motor driven socket 172 to the motor means can be engaged. The clutch (not shown) can be constructed in a manner similar to the brake system previously described for setting the torque-limiting stop. Now when the motor means 170 is energized, it will first loosen and then retauten the band 12 in the resuscitative rhythm. One or two cam-operated circuit interrupter switches can be associated with the shaft that drives the socket 172, cooperating with a suitable electrical holding circuit to cause the electric motor, for example, to stop with the socket 172 in the desired maximum-tautness or maximum-looseness position.

As a prime mover, the motor means 170 can utilize an electrical solenoid, an "air" cylinder or vane actuator, an electric motor or other powered device. An air cylinder or solenoid can use a crank with an adjustable throw or other device to convert linear motion to rotary alternating motion of variable amplitude. An electric motor can use a speed reduction gear and a rotary motion to alternating rotary motion converter using a crank member with an adjustable throw. Commercial motorspeed reducer combinations having a maximum output speed of fifty-eight rpm are considered adequate for this application. A motor speed control to provide a range of lesser speeds is recommended. Controls for the compressed gas and solenoid actuators described in some of the prior art, supra, may be adequate, although valve or relay controls using variable speed motor and cam arrangements or elementary microprocessor circuits may be preferred. High reliability of these systems is of great importance.

In the prototype that was constructed the band 12 was 8½ inches (22 centimeters) wide, constructed of fabric made of polyamide plastic fibers as sold under the trademark Nylon, weighing two ounces per square yard (70 grams per square meter), that had been impregnated with vinyl plastic. This made a light and very supple band that readily adapts to the contour of the thorax, the rollers, etc. The pull roller 72 was five inches in diameter to provide a five-to-one mechanical advantage when using the manual operating handle. The force intensifier 156 was three inches in diameter and covered with 3/16-inch (½-centimeter) surface-cushioning material. The slide for the movable band-guide was lubricated with a silicone lubricant spray, and typically moved about ½-inch (1¼ centimeters) when exerting the clasping action during the resuscitative rhythm. The band was fully loosened by the natural expansion of the thorax per se when the pull on the operating handle was retracted smartly. This favorable result is attributed to the friction-reducing effect of the band-guide rollers 28 and 30. Possibly an adequately similar result can be obtained by reshaping and coating the convex portions of the contoured pieces 20 and 22 with polytetrafluoroethylene resin plastic and omitting the rollers.

While the invention has been shown and described as specific procedures and specific apparatus, such showing and description is meant to be illustrative only and not restrictive, since obviously many changes, modifications and outwardly different procedures and apparatus can be adopted and made without departing from the spirit and scope of the invention.

What is claimed is:

1. The method of resuscitating a patient having cardiocirculatory arrest, comprising passing a supple band around the thorax of the patient so that the band is adapted when tautened to conform substantially to the contour of the thorax around a major portion of its periphery, exerting a side-to-side clasping action on the thorax at its posterior side portions and guiding the band for longitudinal movement over the clasped portions so that the tautening of the band exerts the clasping action and produces force components directed inwardly of the thorax around a major portion of its periphery, tautening the band so that the force components produce intrathoracic pressures sufficient to propel the blood of the patient into effective capillary circulation in the extrathoracic regions, loosening the band so as to allow the elastic tissues of the patient's body to return blood to the intrathoracic region, and continuing to alternately tauten and loosen the band in a resuscitative rhythm.

2. A method as in claim 1 that comprises juxtaposing the patient with a base member and with first and second band-guide members contoured to clasp the thorax at its side portions, and traversing one of the band-guide members with respect to the base member in order to exert the clasping action.

3. A method as in claim 2 that comprises directing X rays to pass between the band-guide members, from one of the front and rear portions of the thorax to the other and through the band, and detecting the rays emerging from the thorax to produce a visual image of structures inside the thorax.

4. A method as in claim 3 wherein the base member has a portion constructed of a material having substantially uniform thickness, low density, and a low effective atomic number, comprising passing the directed X rays through said portion of the base member.

5. A method as in claim 2 wherein the base member comprises a support for the patient, the method comprising placing the patient on the support as a preliminary resuscitative action.

6. A method as in claim 5 comprising lifting the base member to transport the patient from one place to another.

7. A method as in claim 6 comprising continuing the resuscitative rhythm of alternately tautening and loosening the band while the patient is being transported.

8. The method of resuscitating a patient having cardiocirculatory arrest, comprising passing a supple band around the thorax of the patient so that the band is adapted when tautened to conform substantially to the contour of the thorax around a major portion of its periphery, exerting a side-to-side clasping action on the thorax at its side portions and guiding the band for longitudinal movement over the clasped portions so that the tautening of the band exerts the clasping action and produces force components directed inwardly of the thorax around a major portion of its periphery, tautening the band so that force components produce intrathoracic pressures sufficient to propel the blood of the patient into effective capillary circulation in the extrathoracic regions, said tautening step comprising drawing two end portions of the band substantially equal distances to the same side of the thorax while opposing bodily movement of the thorax to said same side, loosening the band so as to allow the elastic tissues of the patient's body to return blood to the intrathoracic region, and continuing to alternately tauten and loosen the band in a resuscitative rhythm.

9. A method as in claim 8 wherein the band is drawn to the one side of the thorax by wrapping the two end portions of the band on a pull roller and exerting a torque on the pull roller in order to tauten the band.

10. A method as in claim 9 that comprises measuring the torque on the pull roller as a parameter affecting the tautness of the band, setting a limit for the torque, and enforcing the limit each time the band is tautened.

11. A method as in claim 10 that comprises measuring the longitudinal distance traveled by a portion of the band as a parameter affecting the tautness of the band.

12. A method as in claim 10 that comprises enforrcing the limit by arranging a mechanical stop means to provide a barrier to further movement of the pull roller to tighten the band.

13. The method of resuscitating a patient having cardiocirculatory arrest, comprising passing a supple band around the thorax of the patient so that the band is adapted when tautened to conform substantially to the contour of the thorax around a major portion of its periphery, exerting a side-to-side clasping action on the thorax at its side portions and guiding the band for longitudinal movement over the clasped portions so that the tautening of the band exerts the clasping action and produces force components directed inwardly of the thorax around a major portion of its periphery, tautening the band so that the force components produce intrathoracic pressures sufficient to propel the blood of the patient into effective capillary circulation in the extrathoracic regions, loosening the band so as to allow the elastic tissues of the patient's body to return blood to the intrathoracic region, continuing to alternately tauten and loosen the band in a resuscitative rhythm, setting an adjustable limit, after the band is in place around the thorax, for a parameter affecting the tautness of the band in accordance with the patient's body size and the amount of pressure to be applied to the thorax, and enforcing the limit each time the band is tautened.

14. A method as in claim 13 that comprises enforcing the limit by arranging a mechanical stop means to provide a barrier to further movement of a portion of the band in the direction that increases the tautness of the band.

15. A method as in claim 13 wherein the clasped portions are the posterior side portions.

16. A method as in claim 15 that comprises measuring the longitudinal distance traveled by a portion of the band as a parameter affecting the tautness of the band.

17. A method as in claim 13 wherein the tautening step comprises drawing two end portions of the band substantially equal distances to the same side of the thorax while opposing bodily movement of the thorax to said same side.

18. The method of resuscitating a patient having cardiocirculatory arrest, comprising passing a supple band around the thorax of the patient so that the band is adapted when tautened to conform substantially to the contour of the thorax around a major portion of its periphery, exerting a side-to-side clasping action on the thorax at its side portions and guiding the band for longitudinal movement over the clasped portions so that the tautening of the band exerts the clasping action and produces force components directed inwardly of the thorax around a major portion of its periphery, tautening the band so that the force components produce intrathoracic pressures sufficient to propel the blood of the patient into effective capillary circulation in the extrathoracic regions, loosening the band so as to allow the elastic tissues of the patient's body to return blood to the intrathoracic region, continuing to alternately tauten and loosen the band in a resuscitative rhythm, juxtaposing the patient with a base member and with first and second band-guide members contoured to clasp the thorax at its side portions, traversing one of the band-guide members with respect to the base member in order to exert the clasping action, and using the other band-guide member to oppose bodily movement of the thorax to the one side.

19. A method as in claim 18 that comprises holding said other band-guide member in a fixed position with respect to the base member.

20. The method of resuscitating a patient having cardiocirculatory arrest, comprising passing a supple band around the thorax of the patient so that the band is adapted when tautened to conform substantially to the contour of the thorax around a major portion of its periphery, exerting a side-to-side clasping action on the thorax at its side portions and guiding the band for longitudinal movement over the clasped portions so that the tautening of the band exerts the clasping action and produces force components directed inwardly of the thorax around a major portion of its periphery, tautening the band so that the force components produce intrathoracic pressures sufficient to propel the blood of the patient into effective capillary circulation in the extrathoracic regions, loosening the band so as to allow the elastic tissues of the patient's body to return blood to the intrathoracic region, continuing to alternately tauten and loosen the band in a resuscitative rhythm, intensifying the inwardly directed force components on one portion of the thorax by placing a semi-rigid, surface-cushioned pad between the thorax portion and the band.

21. An apparatus for use in resuscitating a patient having cardiocirculatory arrest, comprising supple band means adapted to be passed around the thorax of the patient, first and second band-guide means for exerting a side-to-side clasping action on the thorax at its side portions, and for guiding the band for longitudinal movement over the clasped portions while adapting the band when tautened to conform substantially to the contour of the thorax around a major portion of its periphery and to exert the clasping action, thereby producing force components directed inwardly of the thorax around a major portion of its periphery, and means cooperating with one of the band-guide means for drawing a portion of the band to one side of the thorax while opposing bodily movement of the thorax toward said one side, thereby to tauten the band so that the force components produce intrathoracic pressures sufficient to propel the blood of the patient into effective capillary circulation in the extrathoracic regions, the drawing means being operable at a cardiac resuscitative rate to alternately so tauten and then loosen the band to permite the elastic tissues of the patient's body to return blood to the intrathoracic region.

22. An apparatus as in claim 21 wherein the band-guide means is adapted to clasp the thorax at its posterior side portions.

23. An apparatus as in claim 21 or claim 22 comprising adjustable means for setting a limit for a parameter affecting the tautness of the band after the band is in place around the thorax.

24. An apparatus as in claim 23 which comprises means for automatically enforcing to the limit each time the band is tautened.

25. An apparatus as in claim 23 comprising means for measuring the longitudinal distance traveled by a portion of the band as a parameter affecting the tautness of the band.

26. An apparatus as in claim 25 wherein the distance-traveled measuring means comprises indicia on the surface of the band.

27. An apparatus as in claim 26 that comprises enforcing the limit by mechanically stopping movement of a portion of the band in the direction that increases the tautness of the band.

28. An apparatus as in claim 27 comprising rotary brake means for determining the position of the pull roller when the mechanical stop is engaged, and wherein the limit-setting means comprises means for setting the brake means.

29. An apparatus as in claim 26 wherein the means for drawing a portion of the band to the one side of the thorax comprises a pull roller adapted to have a portion of the band wrapped thereon, and wherein the limit setting means comprises means for setting a mechanical stop for the movement of the pull roller.

30. An apparatus as in claim 21 wherein the band comprises two separate, rejoinable portions which tend to move in opposite directions when the band is tautened.

31. An apparatus as in claim 21 wherein the band comprises two separate rejoinable end portions faced with mating hook and loop fastener panels.

32. An apparatus as in claim 21 comprising a base member adapted to have the band pass between the thorax and the base member, and means mounting the other band-guide means for traversing movement with respect to the base member to exert the clasping action.

33. An apparatus as in claim 32 wherein the one band-guide means is secured to the base member.

34. An apparatus as in any one of claims 21, 32, or 33, comprising means for directing X rays to pass between the first and second band-guide means, from one of the front and rear portions of the thorax to the other and through the band, and means for detecting the rays emerging from the thorax to produce a visual image of structures inside the thorax.

35. Apparatus as in claim 34 comprising a base member portion adapted to be located in the path of the directed X rays, said base member portion being constructed of a material having substantially uniform thickness, low density, and a low effective atomic number.

36. An apparatus as in claim 21 wherein the means for drawing a portion of the band to the one side of the thorax comprises a pull roller adapted to have two end portions of the band wrapped thereon, so as to draw end portions substantially equal distances to the same side of the thorax, and means for exerting a torque on the pull roller to tauten the band.

37. An apparatus as in claim 36 wherein the torque exerting means comprises hand-operated lever means having a multiplicity of operating positions.

38. An apparatus as in claim 37 wherein the lever means includes torque-measuring means.

39. An apparatus as in claim 37 wherein the lever means includes torque-limiting means.

40. An apparatus as in claim 36 wherein the torque-exerting means comprises motor means.

41. An apparatus as in claim 36 comprising adjustable means for setting a limit for the torque on the pull roller after the band is in place around the thorax as a parameter affecting the tautness of the band.

42. An apparatus as in claim 41 which comprises means for enforcing the limit each time the band is tautened.

43. An apparatus as in claim 42 wherein the limit-enforcing means comprises mechanical stop means providing a barrier to further movement of the pull roller to tauten the band.

44. An apparatus as in claim 23 comprising rotary brake means for determining the position of the pull roller when the mechanical stop means is engaged, and wherein the limit setting means comprises means for setting the brake means.

45. Apparatus as in claim 32 or claim 33 wherein the base member is adapted to provide a support for the patient.

46. Apparatus as in claim 45 comprising handles attached to the base member for lifting the base member in order to thereby transport the patient.

47. Apparatus as in claim 21 comprising a semirigid, surface-cushioned pad adapted to be placed between the band and a selected portion of the thorax to locally intensify the inwardly directed force components on the selected portion.

48. An apparatus as in claim 47 wherein the pad comprises a plurality of substantially rigid disks that are axially interconnected by a flexible member, the disks having firm cushiony material on their peripheral surfaces.

* * * * *